US008250676B2

(12) United States Patent
Ramsey et al.

(10) Patent No.: US 8,250,676 B2
(45) Date of Patent: Aug. 28, 2012

(54) SELECTIVELY FELTABLE GARMENT

(75) Inventors: John Ramsey, Signal Mountain, TN (US); Glenn Buchan, Grand Junction, CO (US)

(73) Assignee: Smartwool LLC, Steamboat Springs, CO (US)

( * ) Notice: Subject to any disclaimer, the term of this patent is extended or adjusted under 35 U.S.C. 154(b) by 340 days.

(21) Appl. No.: 12/754,506

(22) Filed: Apr. 5, 2010

(65) Prior Publication Data

US 2011/0239352 A1 Oct. 6, 2011

(51) Int. Cl.
*A41B 11/00* (2006.01)

(52) U.S. Cl. ..... 2/239; 66/185; 66/202

(58) Field of Classification Search ..... 2/239, 240, 2/241, 243.1; 66/177, 178 R, 182–187, 178 A, 66/194, 202
See application file for complete search history.

(56) References Cited

U.S. PATENT DOCUMENTS

| | | | | |
|---|---|---|---|---|
| 2,144,563 | A * | 1/1939 | Davis | 66/182 |
| 2,370,450 | A * | 2/1945 | Clarke | 66/185 |
| 2,384,079 | A * | 9/1945 | Davis | 66/182 |
| 4,255,819 | A | 3/1981 | Klingspor | |
| 4,373,361 | A | 2/1983 | Thorneburg | |
| 4,520,635 | A | 6/1985 | Shields et al. | |
| 4,631,755 | A | 12/1986 | Zingg et al. | |
| 4,898,007 | A * | 2/1990 | Dahlgren | 66/185 |
| 5,555,565 | A * | 9/1996 | Gallagher, Jr. | 2/239 |
| 5,724,836 | A * | 3/1998 | Green | 66/185 |
| 6,308,337 | B1 * | 10/2001 | Penley | 2/239 |

FOREIGN PATENT DOCUMENTS

JP 10-110378 A 4/1998

OTHER PUBLICATIONS

International Search Report and Written Opinion dated Dec. 7, 2011 for Intl. Appl. No. PCT/US2011/031106; 10 pp.
SHOP Wiki, Patagonia Heavyweight Mountaineering Sock, http://www.shopwiki.com/detail/?q=felted+sock&s=16370&o=345477392&d=Patagonia+Heavyweight+Mountaineering+Sock, Accessed Jan. 8, 2009.
Mogmoc, Socks, http://www.mogmoc.com/socks.htm, Accessed Jan. 8, 2009.
Brands Fitness & Cycle, Craft Thermal Bike Training Sock, http://brandscycle.com/itemdetails.cfm!id=9730, Accessed Jan. 8, 2009.
Knitty—Fuzzy Feet, Felted Wool Slipper, http://www.knitty.com/ISSUEwinter02/PATTfuzzyfeet.html, Accessed Jan. 8, 2009.

* cited by examiner

*Primary Examiner* — Amy Vanatta
(74) *Attorney, Agent, or Firm* — Holland & Hart LLP

(57) ABSTRACT

Garments are provided that include feltable fibers in selected areas to provide high durability. Garments are manufactured with feltable fibers is selected areas, such as high wear or high impact areas, and are then subjected to the felting (or fulling) process to produce a garment having partially felted fibers on the selected areas. Such a garment may be a sock with felted areas selected in the heel and toe areas. Such socks have enhanced resistance to wear in these high wear areas, and therefore are useable for longer periods of time for the user of the sock.

20 Claims, 3 Drawing Sheets

SELECTIVELY FELTABLE GARMENT

FIELD

The present invention is related to knitted clothing articles, and more specifically to knit clothing articles with selected areas knit with yarn having feltable fibers.

BACKGROUND

Knit clothing articles are well known and ubiquitous around the globe. Such clothing is made from fabric that is manufactured by knitting yarn according to well known techniques. As is also well known, such clothing articles become worn after repeated use, eventually to the point of no longer being useful. Traditionally, methods of extending the useful lifetime of clothing articles include, for example, providing reinforcing or additional material in known high-wear areas of an article of clothing. Such material includes, for example, patches of other fabric, leather, or synthetic material placed in the high-wear areas.

One type of fabric that is well known and highly durable is felt. Felt is a non-woven cloth that is produced by matting, condensing and pressing wool fibers. Felt may be used in a variety of applications, including garments and construction materials. Felt is made by a process called felting, where natural wool fiber is stimulated by friction and lubricated by moisture (such as soapy water), using the inherent nature of wool, the fibers of which have directional scales on them. The fibers also have kinks in them, and the combination of scales and kinks reacts to the stimulation of friction, and causes the phenomenon of felting. Felting tends to work well with wool fibers as their scales, when aggravated, bond together to form a cloth.

Knitted woolen garments which shrink in a hot machine wash can be said to have felted or fulled. Felting differs from fulling in the sense that fulling is done to fabric whereas felting is done to fibers that are not in fabric form, although the term felting is often used colloquially to refer to either process. A clothing article, for example, that is knitted using wool yarn, and is then washed, will shrink significantly from the fulling process. Fulling is an example of how the fibers bond together when combined with the movement of the washing machine, the heat of the water, and the addition of soap. The fabric from either process may be referred to as felt or as having been felted. As used herein, the term felt or felted is used to refer to fabric that has been through the felting or fulling process.

As is well known, in many cases it is not desirable for a garment to become felted. To help reduce or eliminate any felting that can occur in garments, and allow for a user to machine wash such garments, wool fibers can be treated to reduce or eliminate the tendency for garments made from wool to felt. Such treatment is referred to as superwashing, and wool fibers that are subjected to superwashing may be spun into yarn or other threads. Such yarn or thread is referred to as superwash yarn, or superwash wool. In cases where yarn or thread is spun from wool fibers that have not had such treatment, such yard is referred to as non-superwash yarn or non-superwash wool.

SUMMARY

Embodiments disclosed herein provide systems and methods for producing garments that include feltable fibers in selected areas. These garments are then subjected to the felting (or fulling) process and produce a garment having partially felted fibers on the selected areas. In various embodiments, the selected areas with felted fibers are the areas of the garment that receive, generally, significant amounts of wear. In one embodiment, the garment is a sock, with areas selected in the heel and toe areas that have felted fibers. Such socks have enhanced resistance to wear in these high wear areas, and therefore are useable for longer periods of time for the user of the sock. Of course, it will be readily understood that such techniques may be applied to other garments as well.

In one aspect, the present disclosure provides a sock comprising a leg portion; and a foot portion connected to the leg portion, the foot portion comprising a heel portion, an arch portion, and a toe portion. In this aspect, at least the heel portion and toe portion comprise a first yarn and a second yarn stitched together to form an inside surface of the heel and toe portions, the first yarn consisting of non-feltable fibers, and the second yarn comprising both feltable and non-feltable fibers. In one embodiment, the first yarn comprises a 100% superwash merino wool yarn, such as a 1/26 worsted 100% superwash ring spun merino wool yarn. In an embodiment, the second yarn is a blend yarn comprising 50% superwash 50% non-superwash merino wool, such as a 1/26 worsted 50% non-superwash, 50% superwash ring spun merino wool blended yarn.

Another aspect of the disclosure provides a sock comprising a leg portion, a foot portion connected to the leg portion that is adapted to receive the foot of a wearer, the foot portion comprising a heel portion, an arch portion, and a toe portion. In this aspect, the heel portion and arch portion have a generally tubular configuration having a top and a bottom, the top corresponding to the top of the foot of a wearer and the bottom corresponding to the bottom of the foot of the wearer, wherein (i) the inside surface of the heel portion includes a terry material located at the bottom of the heel portion and a non-terry material located at the top of the heel portion, and (ii) the inside surface of the arch portion includes a terry material located at the bottom of the arch portion and a non-terry material located at the top of the arch portion. The yarn used to form the terry material of the heel portion comprises feltable fibers and the yarn used to form the terry material of the arch portion is different than the yarn used to form the terry material of the heel portion. In one embodiment, the yarn used to form the terry material of the arch portion consists of non-feltable fibers. The terry material of the heel portion, in another embodiment, comprises a first yarn and a second yarn stitched to form loop pile meshes, said first yarn consisting of non-feltable fibers, and said second yarn comprising both feltable and non-feltable fibers. The inside surface of the toe portion may also include a first yarn and a second yarn stitched to form loop pile meshes, the first yarn consisting of non-feltable fibers, and the second yarn comprising both feltable and non-feltable fibers. In an embodiment, the yarn used to form the terry material of the heel portion comprises a blend yarn comprising 50% superwash, 50% non-superwash merino wool.

DETAILED DESCRIPTION

Figure 1:
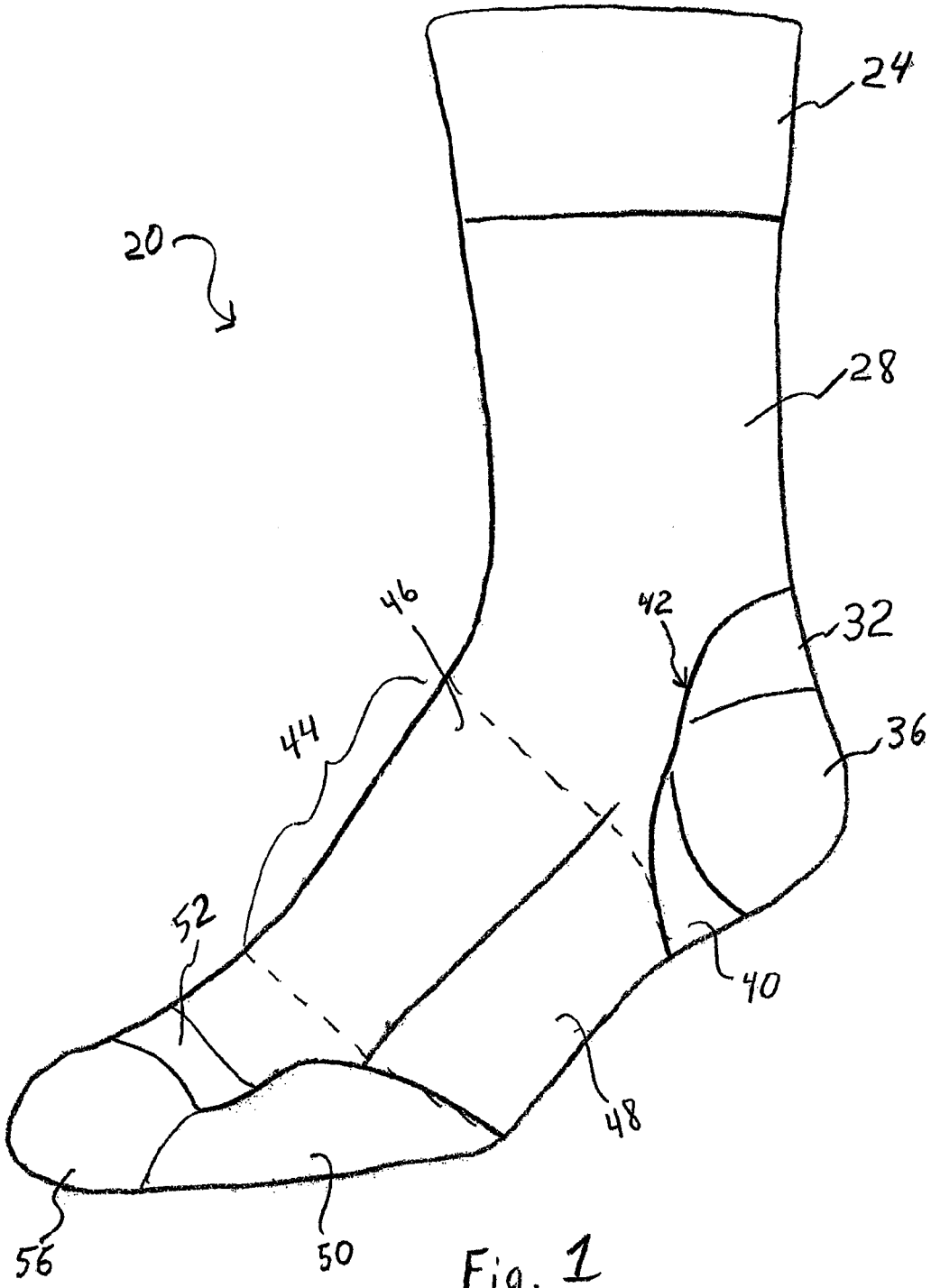
FIG. 1 is an illustration of a sock of an embodiment of the disclosure.

The present disclosure recognizes that existing garments have areas of high wear and, if the high wear areas are constructed to be more durable, garments may have a longer useful life. For example, previous sock constructions are largely knit the same, meaning the yarns are placed in the same areas. The present disclosure provides garments in which different yarns, having different desired properties, are placed strategically in areas having different wear patterns.

The present disclosure provides garments that are constructed with feltable yarns incorporated into selected areas of the garment. As the garment is used and washed, the felting process generates at least a partially felted area corresponding to the areas in which the feltable yarns are incorporated. As described above, felted material is highly durable and can withstand significantly more wear than material that is not felted. However, the felting process also has significant impacts on the size and shape of the original material that has undergone the felting process. For example, felted material has relatively little yield and therefore does not expand or contract significantly, as compared to a material that is constructed to expand and contract. For example, it is well known that socks may be constructed from knit material that includes yarns that are knitted together to form a tubular construction that expands to accommodate the foot or lower leg of a wearer. The yarns in socks may also include elastic to enhance the ability for the sock material to expand and contract to accommodate the foot or leg of the wearer. It is also desirable that the sock provide good air circulation in order to keep the wearer's foot relatively dry, to promote comfort as well as reduce the growth of bacteria.

If garment material is constructed from fibers that are feltable, the shape of the garment will become drastically deformed when the material undergoes the felting process. For example, if a sock were constructed of feltable fibers, the original form of the sock would change as a result of the felting process. Furthermore, felted material does not have many desirable characteristics, such as stretching and contracting to accommodate the foot and leg or a wearer. Additionally, such material generally takes a large number of wash and dry cycles to become fully felted, leading to continual deformation of material shape and size over time.

Socks have been proposed in which feltable fibers are used to construct the heel and toe regions of the sock, such as in U.S. Pat. No. 4,255,819 (referred to as "the '819 patent"). In this construction, feltable wool yarn is used to form loop pile meshes on both the external and internal surfaces of the heel, sole, and toe regions of the sock. This sock is then subjected to a felting (or fulling) treatment in which the feltable wool forms felted material. This reference recognizes that the elasticity of these regions will disappear, at least in part, and also that felted material will also have diminished air circulation. In practice, a sock constructed as described in this reference will have a significantly reduced air circulation that results in increased moisture and discomfort for the wearer. Furthermore, as the sock is continually used, further matting of the felted areas will occur that leads to additional deformation of the sock shape, as well as additional stiffening of the material and loss of elasticity. Another reference, U.S. Pat. No. 4,631,755 (referred to at "the '755 patent"). describes a sock that incorporates feltable fibers. This reference recognizes that a sock such as described in the '819 patent has significant moisture and fit problems, and proposes a sock construction in which feltable fibers are incorporated only on outer surfaces of the sock, away from the skin of the wearer. The '755 patent describes that such a construction provides better moisture control as well as better fit. Again, however, as such a sock is continually used, further matting of the felted areas will occur that leads to additional deformation of the sock shape, as well as additional stiffening of the material and loss of elasticity.

The present disclosure provides garments that incorporate feltable fibers in selected areas based on wear patterns in the selected areas. In various embodiments, socks are provided that include different yarns that are placed in selected areas based on the wear patterns of the particular area and the durability of the yarn fibers. The socks of these embodiments have high wool content which has a number of advantages, such as, for example, enhancing moisture absorption ability, reduction of friction to reduce the chance of blistering, enhanced thermal regulation, reduced bacterial growth, and relatively high sustainability, relative to socks constructed with synthetic fibers. In various embodiments, a feltable yarn is placed in strategic areas (selectively contoured) on interior portions of the sock, that enhance fit and performance of the sock. Socks constructed with such techniques, in some testing, have shown a substantial increase in durability and in some embodiments have had at least a 70% increase in durability, as compared to a sock constructed without the feltable yarn in the strategic areas. A sock of one embodiment includes areas which are knitted using selective terry, in which areas of non-terry, areas of low-density terry, and areas of high-density terry, are combined to form a sock that has desirable characteristics. The terry portion of the areas of high-density terry, in this embodiment, includes a first yarn with non-feltable fibers and a second yarn that has a blend of both feltable and non-feltable fibers. The terry portion of areas of low-density terry, in this embodiment, includes only the first yarn with non-feltable fibers. It is to be understood that when the term "non-feltable" as used herein, refers to fibers, materials, or yarns, that have little or no tendency to felt when subjected to treatments that would otherwise lead to felting of feltable fibers. Terry, as used herein, is used to refer to material or fabric which has loops that are formed by knitting pile stitches of selected yarn.

With reference now to FIG. 1, a sock of an embodiment is described. The sock 20 includes several different areas with the sock construction in different areas being different based on the particular properties of the area. In the embodiment of FIG. 1, the sock 20 includes a welt portion 24. The welt 24 in this embodiment is made of 100% superwash merino wool, nylon, and spandex. Below the welt 24, the sock 20 has a leg section 28, which in this embodiment is constructed from the same material as the welt 24, namely 100% superwash merino wool, nylon, and spandex. The welt 24 and leg 28 of this embodiment are knitted using a circular knitting machine that is capable of knitting selected stitches with pile stitches to form a terry material. The welt 24 and leg 28, of this embodiment, do not include any terry regions, although selective terry regions may be included in one or both of the welt 24 or leg 28 sock portions in other embodiments.

The sock 20 also includes a boot portion 32, a high heel portion 36, and a low heel portion 40. The boot 32, high heel 36, and low heel 40, may be referred to collectively as the heel portion 42 of the sock. In this embodiment, the heel portion 42 is made from a body yarn and a first terry yarn that are both made of non-feltable fibers, and a second terry yarn that is made from a blend of feltable and non-feltable wool fibers. In one embodiment, the second terry yarn is made of 50% superwash merino wool and 50% non-superwash merino wool. Using two different terry yarns, the sock of this embodiment includes an area of high-density terry in the interior side of the heel portion 42. In this embodiment, the circular knitting machine is operated to selectively terry only the heel portion 42 during the knitting of this portion of the tubular sock 20.

The circular knitting machine, in this embodiment, includes the two terry yarns along with the body yarn in this high-density terry area. The boot 32, in some embodiments includes nylon and/or spandex in addition to the wool. As with the boot portion 32, the high heel 36 and/or low heel 40 may also include nylon and/or spandex.

The sock 20 includes an arch portion 44, which in this embodiment is made of 100% super wash merino wool, nylon, and spandex. The arch portion 44, in this embodiment, includes an upper portion 46 and a lower portion 48. The upper portion 46, in this embodiment, is a non-terry area, and the lower portion is a low-density terry area. In this embodiment, the lower portion 48 is made from a body yarn and a first terry yarn that are both made of non-feltable fibers wool fibers. Using first terry yarn, the lower arch portion 48 of this embodiment thus includes an area of low-density terry on the interior side of the arch portion 44. In this embodiment, the circular knitting machine is operated to selectively terry only the lower portion 48 of the arch 44 during the knitting of this portion of the tubular sock 20. The circular knitting machine, in this embodiment, includes the first terry yarn along with the body yarn and a nylon and/or spandex yarn, in this low-density terry area.

Adjacent to the arch portion 44, in this embodiment, is a ball portion 48. In the embodiment of FIG. 1, the ball 50 is constructed in the same manner with the same constituent yarns and selective high-density terry as the heel portion 42. In one embodiment, the heel 42, arch 44, and ball 50 are selectively contoured to provide a different look and feel as compared to adjoining areas. A ring toe section 52, and a toe section 56 are located at the toe-end of the sock 20. In this embodiment, the ring toe section 52 and toe section 56 are constructed in the same manner with the same constituent yarns and selective high-density terry as the ball portion 50 and heel portion 42.

Socks which are constructed in such manners are performance socks high in wool content, and have desirable moisture control, reduced bacterial growth, and desirable thermal regulation. Furthermore, such socks have feltable material located on an interior portion of selected areas of the sock. This feltable material, in conjunction with the non-feltable material in these regions, provides an area that, upon felting treatment, has high durability while allowing sufficient air flow and sufficient elasticity to maintain a comfortable fit. Furthermore, when the sock continues to be worn, the felting in the feltable areas continues, with the feltable material in these areas being sufficient to provide high durability but not so significant to significantly affect the fit and elasticity of the sock. The elasticity of the feltable areas is reduced as compared to other areas, and continues to be reduced as the sock is worn, but the selective and targeted placement of these areas is such that the sock maintains a good fit overall over the lifetime of the garment.

As will be understood, the sock of this embodiment is just one example of a garment which may be constructed according to the present disclosure. Other types of socks, and other garments are considered to be within the teachings of the present disclosure. The yarns used to produce such garments may include 1/26 wc, 1/27 wc, 1/28 wc, and/or 1/14 wc 100% superwash merino wool and any combination of these yarns, along with 1/26 wc 100% non-superwash merino wool or a blend of superwash merino and non-superwash merino wool. The blend of superwash merino and non-superwash merino wool may have a wide range, depending upon the application and use expected for the garment, and the size of the area that will include the feltable fibers. The blended wool and may range from 99% superwash merino and 1% non-superwash merino to 1% superwash merino and 99% non-superwash merino, and any range in between. As will be readily recognized by one of skill in the art, other types of wool may be used in such garments. Furthermore, as mentioned, socks are just one example of a garment in which the concepts described herein may be used, and other embodiments use similar constructions in other types of garments, such as shirts, sweaters, pants, mittens, gloves, and hats, to name but a few examples. Yarns used to construct the garments may also include filament nylon, and filament spandex, for example. Superwash wool has been found to contribute to comfort and performance, moisture management, control of bacterial growth, and thermal regulation. Non-superwash wool, and or a blend of superwash and non-superwash wool has been found to contribute to moisture management, thermal regulation, control of bacterial growth, shock absorption, and enhanced durability. As such, in many embodiments non-superwash wool yarn, or a yarn having a blend of superwash and non-superwash wool yarn, is used in relatively high wear areas of the garment and provide enhanced durability of these areas, and thus a longer useful life for the garment. Nylon yarns in some embodiments provide a foundation for the wool to be built on and may add aesthetic value. Spandex in some embodiments is included in the garment construction to add stretch and recovery for enhanced fit.

More specifically, in various embodiments, superwash wool and non-superwash wool are knitted together in high impact zones and typical wear areas of a garment. In one embodiment, the heel portion 42, ball 50, and toe 56 sections of a sock such as in FIG. 1 are knitted using a yarn having a blend of non-superwash wool and superwash wool. The superwash wool does not felt or has relatively little felting, and the non-superwash wool does felt. In such a manner, the superwash wool enhances comfort and the non-superwash wool enhances shock absorption and durability. As mentioned above, superwash wool is shrink treated to prevent or reduce shrinking and felting during consumer washing and drying, and non-superwash wool is not shrink treated and will shrink and felt during consumer washing and drying. A significant challenge is how to use both types of yarn or thread, and get the acceptable performance out of both but maintain moisture and thermal properties, and size, shape, and fit after consumer washing and drying. Fit is adversely affected when fibers shrink and felt, but in various embodiments both types of yarns are knit together on the same stitch, and knit together only in strategic areas, so as to maintain size, shape, and fit after consumer washing and drying. Additionally, other natural or synthetic fibers could be blended with non-superwash wool and used in similar applications.

Figure 2:
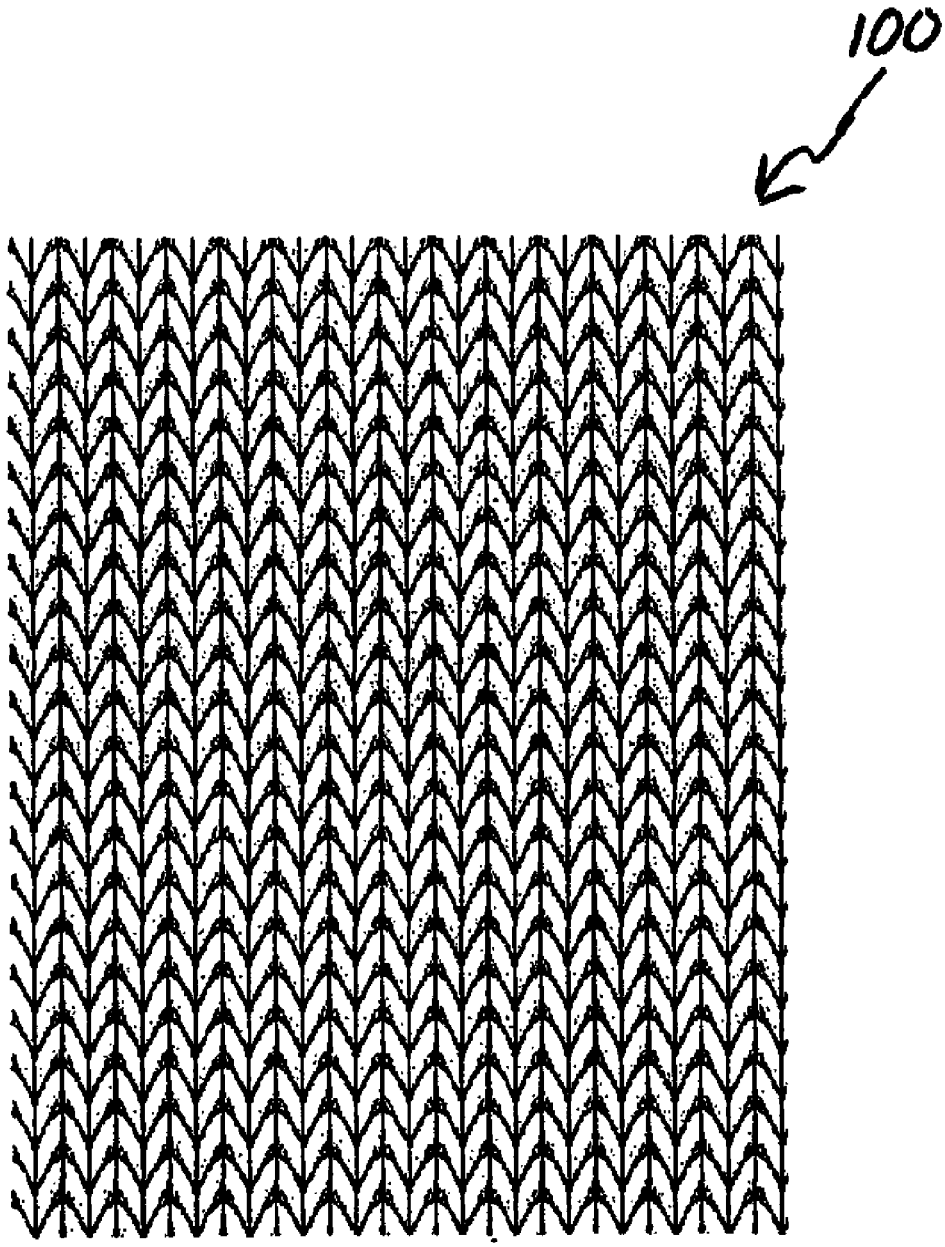
FIG. 2 illustrates a knitted fabric according to an embodiment of the disclosure.
Figure 3:
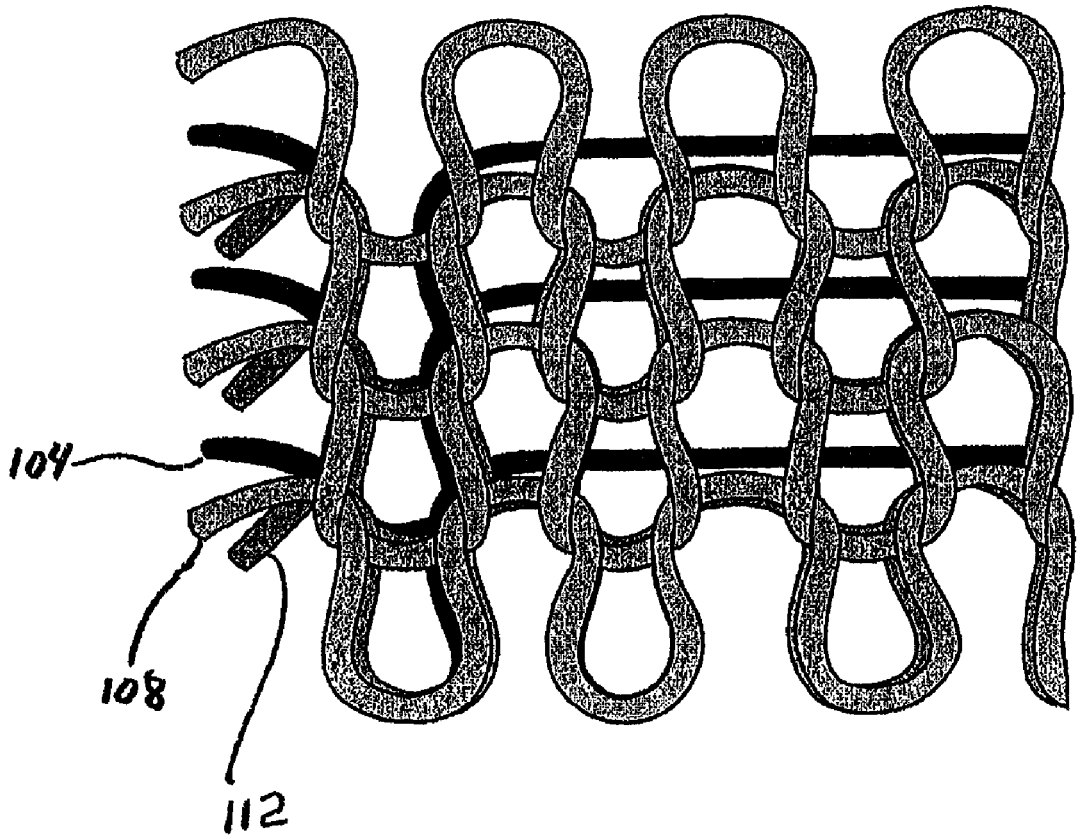
FIG. 3 illustrates a number of stitches and the different yarns included in such stitches according to an embodiment of the disclosure.

With reference now to FIGS. 2-3, a fabric 100 constructed from yarns as described above will now be discussed. In the embodiment of FIG. 2, the fabric is a knit fabric that includes three separate yarns. As best seen with reference to FIG. 3, a number of stitches for fabric 100 is illustrated which include a number of separate yarns, including a first yarn 104, a second yarn 108, and a third yard 112. In this embodiment, the first yarn 104 is an air-covered nylon spandex yarn. Such a yarn is well known, and comprises a spandex yarn that is covered with nylon through the use of an air covering process in which a spandex thread is covered with nylon. This first yarn 104, in this embodiment is a plaiting yarn. In one embodiment, the first yarn 104 is 78/24/2 nylon air covered over 20 denier spandex yarn. The second yarn 108, in this embodiment, is a blend yarn which includes 50% superwash 50% non-superwash merino wool. In one embodiment the second yarn 108 is a 1/26 worsted 50% non-superwash, 50% superwash ring spun merino wool blended yarn, which is used as a reinforcing yarn. The third yarn 112, in the embodiment of FIG. 3, is a 100% super wash merino wool yarn. In one embodiment, the third yarn 112 is a 1/26 worsted 100% superwash ring spun merino wool yarn, which is used as a body yarn. In certain embodiments, the second yarn 108 is knitted to form loop pile meshes on an internal portion, or internal portions, of the garment. In some embodiments, a circular knitting machine is used to selectively terry portions of the interior of the socks with loop pile meshes of the second and/or third yarns. In one embodiment, different types of selective terry areas are included in the same garment, one type selective terry area including only non-feltable fibers, and another type of selective terry area including a combination of non-feltable and feltable fibers.

Furthermore, as discussed above, socks are just one example of a garment in which the concepts described herein may be used, and other embodiments use similar constructions in other types of garments, such as shirts, sweaters, pants, mittens, gloves, and hats, to name but a few examples. For example, a knit sweater may be constructed using the described techniques to incorporate non-superwash wool into an elbow area to allow selective felting in this area and increase durability. Similarly, a pair of gloves or glove liners may be constructed using the described techniques to incorporate non-superwash wool into a thumb and index finger area to allow selective felting in these areas and increase durability.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A sock comprising:

a leg portion;

a foot portion connected to said leg portion, said foot portion comprising a heel portion, an arch portion, and a toe portion;

at least said heel portion and said toe portion comprising selectively feltable regions that are formed by at least a first yarn and a second yarn stitched together to form knitted pile stitches on an inside surface of said heel and toe portions, said first yarn consisting of non-feltable fibers, and said second yarn comprising both feltable and non-feltable fibers.

2. The sock as claimed in claim 1 further comprising a welt portion connected to said leg portion, said leg portion located between said welt portion and said foot portion.

3. The sock as claimed in claim 2 wherein said leg portion and said welt portion comprise at least said first yarn and a third yarn, said third yarn comprising nylon and spandex.

4. The sock as claimed in claim 1 wherein said foot portion further comprises a ring toe portion between said toe portion and said arch portion.

5. The sock as claimed in claim 1 wherein said arch portion comprises at least said first yarn and a third yarn, said third yarn comprising nylon and spandex.

6. The sock as claimed in claim 1, wherein at least said heel portion and said toe portion further comprise a third yarn, said third yarn comprising nylon and spandex.

7. The sock as claimed in claim 1, wherein said first yarn comprises a 100% super wash merino wool yarn.

8. The sock as claimed in claim 7, wherein said first yarn is a 1/26 worsted 100% superwash ring spun merino wool yarn.

9. The sock as claimed in claim 1, wherein said first yarn is a body yarn.

10. The sock as claimed in claim 1, wherein said second yarn is a blend yarn comprising 50% superwash 50% non-superwash merino wool.

11. The sock as claimed in claim 10, wherein said second yarn is a 1/26 worsted 50% non-superwash, 50% superwash ring spun merino wool blended yarn.

12. The sock as claimed in claim 1, wherein said second yarn is used as a reinforcing yarn.

13. The sock as claimed in claim 6, wherein said third yarn comprises a spandex yarn that is covered with nylon.

14. The sock as claimed in claim 6, wherein said third yarn is a plaiting yarn.

15. A sock comprising:

a leg portion;

a foot portion connected to said leg portion that is adapted to receive the foot of a wearer, said foot portion comprising a heel portion, an arch portion, and a toe portion; at least said heel portion and said arch portion having a generally tubular configuration having a top and a bottom, the top corresponding to the top of the foot of a wearer and the bottom corresponding to the bottom of the foot of the wearer, wherein the inside surface of the heel portion includes a first terry material and the inside surface of arch portion includes a second terry material, and wherein the yarn used to form the first terry material comprises feltable fibers and the yarn used to form the second terry material is different than the yarn used to form the first terry material.

16. The sock of claim 15, wherein the yarn used to form the second terry material consists of non-feltable fibers.

17. The sock of claim 15, wherein the first terry material comprises a first yarn and a second yarn stitched to form loop pile meshes, said first yarn consisting of non-feltable fibers, and said second yarn comprising both feltable and non-feltable fibers.

18. The sock of claim 17, wherein the inside surface of said toe portion comprises a first yarn and a second yarn stitched to form loop pile meshes, said first yarn consisting of non-feltable fibers, and said second yarn comprising both feltable and non-feltable fibers.

19. The sock of claim 15, wherein said first terry material is located at the bottom of the heel portion.

20. The sock as claimed in claim 15, wherein the yarn used to form the first terry material comprises a blend yarn comprising 50% superwash 50% non-superwash merino wool.

* * * * *